US007738811B2

(12) United States Patent
Thayer

(10) Patent No.: US 7,738,811 B2
(45) Date of Patent: Jun. 15, 2010

(54) CORONA CHARGING DEVICE CLEANER

(75) Inventor: Bruce E Thayer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 327 days.

(21) Appl. No.: 11/866,439

(22) Filed: Oct. 3, 2007

(65) Prior Publication Data

US 2009/0092410 A1 Apr. 9, 2009

(51) Int. Cl.
*G03G 15/02* (2006.01)

(52) U.S. Cl. ..... 399/100; 399/115; 399/170

(58) Field of Classification Search ..... 399/98, 399/99, 100, 110, 115, 170, 171, 172

See application file for complete search history.

(56) References Cited

U.S. PATENT DOCUMENTS

| | | | | |
|---|---|---|---|---|
| 4,864,363 | A | 9/1989 | Shinada | |
| 5,023,748 | A * | 6/1991 | Okamoto et al. | 399/100 |
| 6,963,705 | B2 | 11/2005 | Quinones | |
| 2004/0013443 | A1 * | 1/2004 | Itoh et al. | 399/100 |

* cited by examiner

*Primary Examiner*—David P Porta
*Assistant Examiner*—Benjamin Schmitt

(57) ABSTRACT

A device that improves the effectiveness of a corona charging element cleaner by forcing it to travel to the end-limits of the outboard end of the corona charging element to ensure that the corona charging element is completely wiped clean. The device uses a pawl and rack to affect a ratchet-like motion, the direction of which permits travel in the opposite direction only after the limit of travel is reached.

17 Claims, 8 Drawing Sheets

CORONA CHARGING DEVICE CLEANER

BACKGROUND 1. Field of the Disclosure

The present disclosure relates to xerographic printing apparatus, and specifically to a mechanism that ensures that a corotron charging device cleaner in a customer replacement unit of the printing apparatus cleans the outboard end of a corotron or corotrons. 2. Description of Related Art Typically, in the process of electrostatographic or xerographic printing, an electrostatic latent image is formed on a charge-retentive surface, and then developed with an application of toner particles. The toner particles adhere electrostatically to the suitably-charged portions of the imaging surface. The toner particles are then transferred, by the application of electric charge, to a print sheet, forming the desired image on the print sheet. An electric charge can also be used to separate or "detack" the print sheet from the imaging surface. For machines using an electrostatic brush cleaner, a preclean electric charge is used to adjust the charge on toner particles entering the electrically biased cleaning brush. In some multiple color machines, e.g., a single pass image on image system, electric charge is used to recharge the toner and photoreceptor from the previous development step prior to development of the next color. In tandem multiple color machines using development to an intermediate surface, electric charge is used for first transfer from each photoreceptor to the intermediate and for second transfer from the intermediate to paper.

For the initial charging, recharging, first transfer, second transfer, detack or preclean of an imaging or intermediate surface, the most typical device for applying a predetermined charge to the imaging surface is a "corotron" of which there are any numbers of variants, such as, the scorotron or dicorotron. Common to most types of corotron is a bare conductor, in proximity to the imaging or intermediate surface, which is electrically biased and thereby supplies ions for charging the imaging or intermediate surface. The conductor typically comprises one or more wires (often called "corona wire") and/or a metal bar forming saw-teeth or pins, the conductor extending parallel to the imaging surface and along a direction perpendicular to a direction of motion of the imaging or intermediate surface. Other structures, such as, a screen, conductive shield and/or nonconductive housing, are typically present in a charging device, and some of these may be electrically biased as well. The corotron will have different design parameters depending on whether it is being used for initial charging, recharging, first transfer, second transfer, detack or preclean.

In printing machines such as the one described above, a CRU is a customer replacement unit which can be replaced by a customer at the end of life or at the premature failure of one or more of the xerographic components. The CRU concept integrates various subsystems whose useful lives are predetermined to be generally the same length. The service replacement interval of the CRU insures maximum reliability and greatly minimizes unscheduled maintenance service calls. Utilization of such a strategy, allows customers to participate in the maintenance and service of their copier/printers. CRUs insure maximum up time of copier/printers and minimize down time and service cost due to end of life or premature failures.

It is important that customer replacement units be customer friendly. That is, it is important that the CRUs may be easily removed and reinstalled with minimal instructions and minimal training. Unfortunately, the CRUs typically include a number of items that are critical to the proper operation of the machine, e.g., charging devices, photoreceptors and toner cleaner subsystems and other subsystems. The components and subsystems are very delicate and need to be properly handled and not damaged during the installation and removal of the CRUs In a practical application of charging devices in these CRUs, dust and other debris may collect in or around the corotron. As a result, such material adversely affects the performance of the corotron, and may cause arcing conditions. Therefore, periodic cleaning of the charging device is performed, such as, by wiping the bare conductor. In high volume machines, corotron cleaning is accomplished with automated wipers, such as, in U.S. Pat. Nos. 4,864,363 and 6,963,705 B2. In U.S. Pat. No. 4,864,363 cleaning members with cleaning pads attached thereto are driven by a feed screw against a corona wire, while in U.S. Pat. No. 6,963,705 B2, a corotron wire is cleaned by a motorized shuttle which travels in two directions along the wire. This wiping may be performed by manually pulling a pad or other material along the corotron wire in lower cost machines. The heretofore mentioned patents are included herein by reference.

In lower volume, lower cost machines, corona charging device cleaners employ brushes or pads to wipe contamination from the corona generating elements (wires or pins). The corona element cleaners are actuated manually by a machine operator. A handle on the cleaning device at the front of the machine is pulled out to draw the cleaning brush or pad along the length of the corona element. Current cleaner designs do not require that the cleaning element be pulled to the very outboard end of the corona element before being pushed back into the machine. If the operator does not pull the cleaner along the entire length of the corona element, then contamination will build up on the uncleaned portion of the corona element and eventually lead to a print defect.

Obviously, there is still a need for a foolproof method and apparatus that will ensure complete cleaning of the corona element in lower volume machines.

SUMMARY

Accordingly, a device is disclosed that improves the effectiveness of the corona charging element cleaner by mechanically ensuring that the cleaner is fully extended before it is able to be reinserted to its stored position. By forcing it to travel to the end-limits, the outboard end of the corona charging element is more completely wiped clean. The device uses a pawl and rack to affect a ratchet-like motion, the direction of which permits travel in the opposite direction only after the limit of travel is reached.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
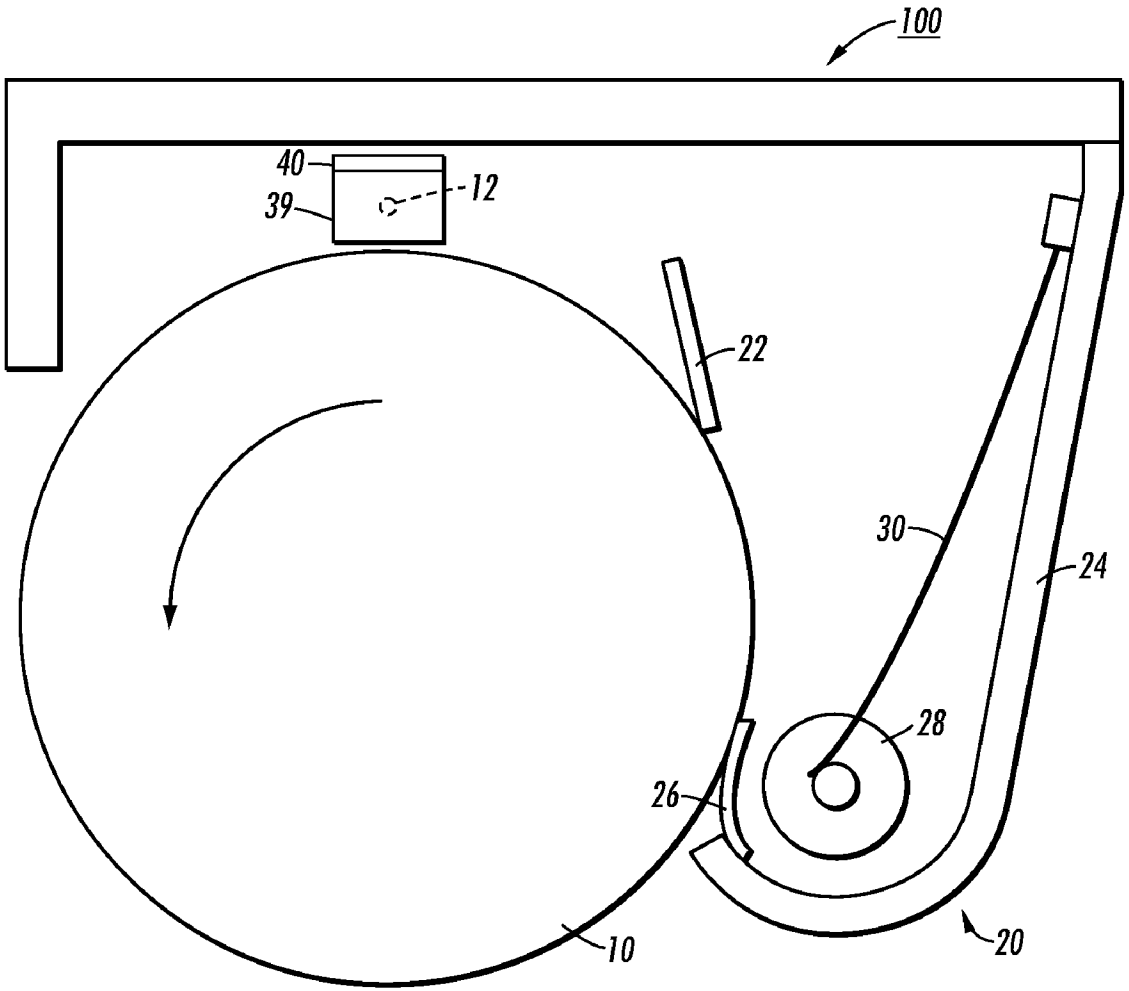
FIG. 1 is a simplified side view of a charging device and cleaning element associated with an imaging surface, as known in the prior art.

For a general understanding of the features of the disclosure, reference is made to the drawings. In the drawings, like reference numerals have been used throughout to identify identical elements.

Figure 2:
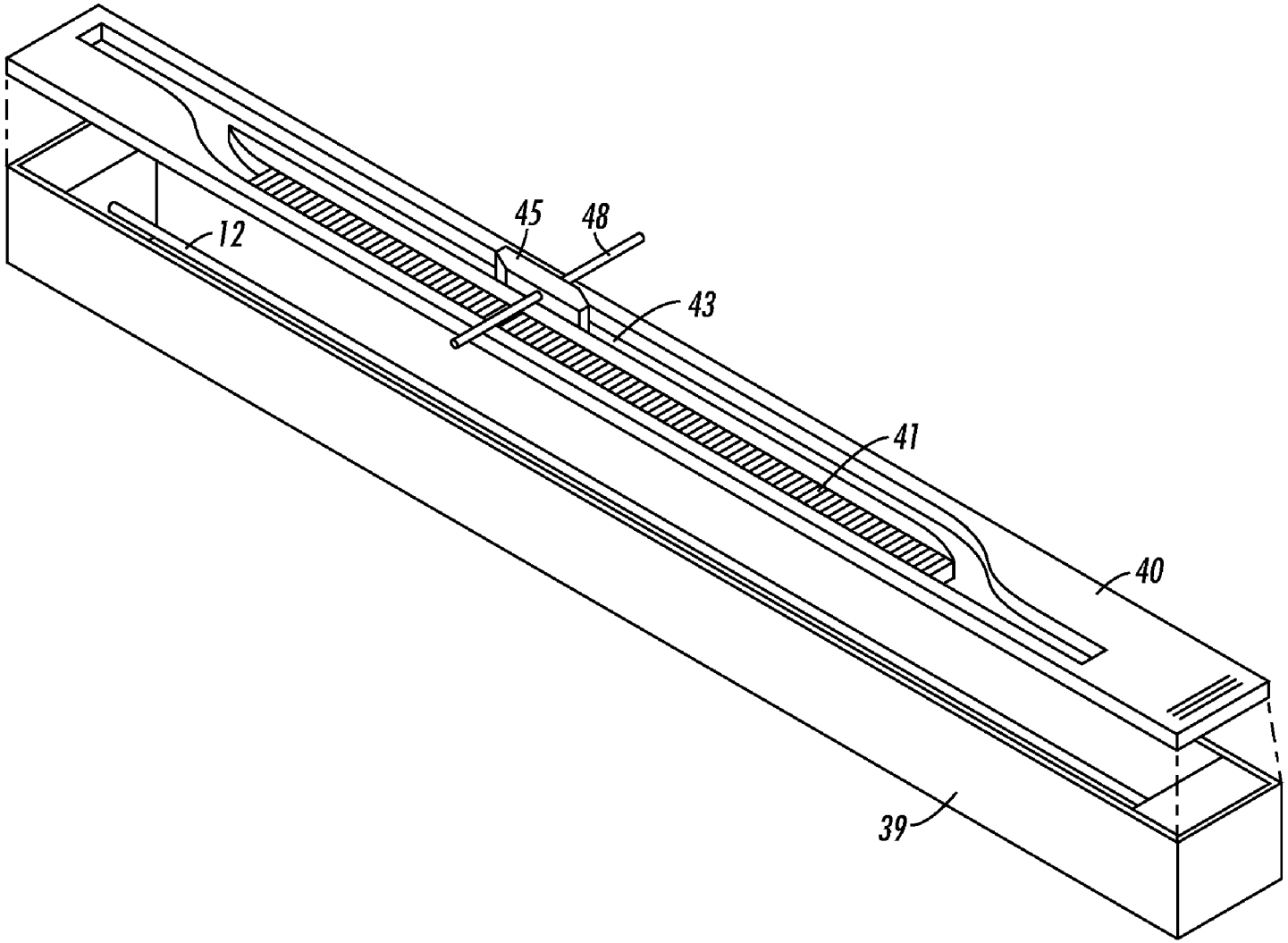
FIG. 2 is perspective view of the charging unit showing the handle of the corotron cleaner partially retracted.

FIG. 1 is a simplified elevational view, and FIG. 2 is a perspective view of the corotron cleaning assembly of the present disclosure, both showing relevant elements of an electrostatographic or xerographic printing apparatus, many of which are disposed within a module or cartridge housing generally shown as 100, and which may in turn be installed in a larger printing machine. As is well known, an electrostatic latent image is created, by means not shown, on a surface of an imaging member, such as, a photoreceptor 10. The latent image is developed by applying thereto a supply of toner particles, such as, with a developer roll (not shown), which may be of any of various designs, such as, a magnetic brush roll or donor roll, as is familiar in the art. The toner particles adhere to the appropriately-charged areas of the latent image. The surface of photoreceptor 10 moves, as shown by the arrow, to a transfer zone created by a transfer-detack device in the printer that would be positioned in the six o'clock position in FIG. 1. Simultaneously, a print sheet on which a desired image is to be printed is conveyed to the transfer zone as well.

At the transfer zone, the print sheet is brought into contact or at least in proximity with a surface of photoreceptor 10, which at this point is carrying toner particles thereon. A corotron or other charge source causes the toner on photoreceptor 10 to be electrically transferred to the print sheet. The print sheet is then sent to subsequent stations, as is familiar in the art, such as, a fuser and finishing devices (not shown).

Following transfer of most of the toner particles to the print sheet in the transfer zone, any residual toner particles remaining on the surface of photoreceptor 10 are removed at a cleaning station, which is generally indicated as 20. A cleaning blade 22 is urged against the surface of photoreceptor 10 and scrapes the residual toner off the surface. The toner which is thus removed falls downward into a hopper 24 formed in housing 100 for accumulating the toner. A flexible seal 26, extending the length of the photoreceptor 10, prevents loose toner from escaping the hopper.

At the bottom of the hopper is an auger 28, shown end-on in the view of FIG. 1. The auger extends substantially the length of the photoreceptor 10. The auger 28 is rotated and thus conveys toner particles at the bottom of the hopper to some sort of waste container (not shown). An agitator 30, made of a thin, flexible material, can interact with the auger to clean the flights of the auger.

As seen in FIG. 2, a corotron cleaner handle 40 is shown partially withdrawn from corotron housing 39. Corotron housing 39 includes at least one corotron or corona wire 12 located within the housing shell. The corona wire 12 is electrically coupled to a high voltage potential source to generate ions or charging current to charge the surface of photoreceptor 10 brought into close proximity with the corona wire. The corona wire is tightly suspended between end blocks, supported in the housing shell, such end blocks being connected to a high voltage source for producing the ion generating condition around the corona wire. A grid (not shown) is located between the corona wire and the photoreceptor surface. The grid is held at a preselected electrical potential to control the specific charge to be laid down on the photoreceptor surface. Cleaning pads (not shown) are connected to handle 40 and positioned within housing 39 to rub against the corotron as handle 40 is retracted from the housing.

Figure 3:
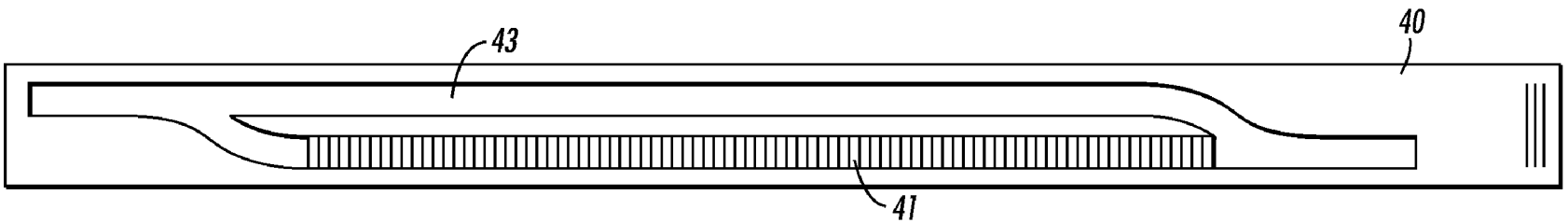
FIG. 3 is a top view of the corotron cleaner handle showing a ratchet track and pawl guide incorporated therein.
Figure 4A:
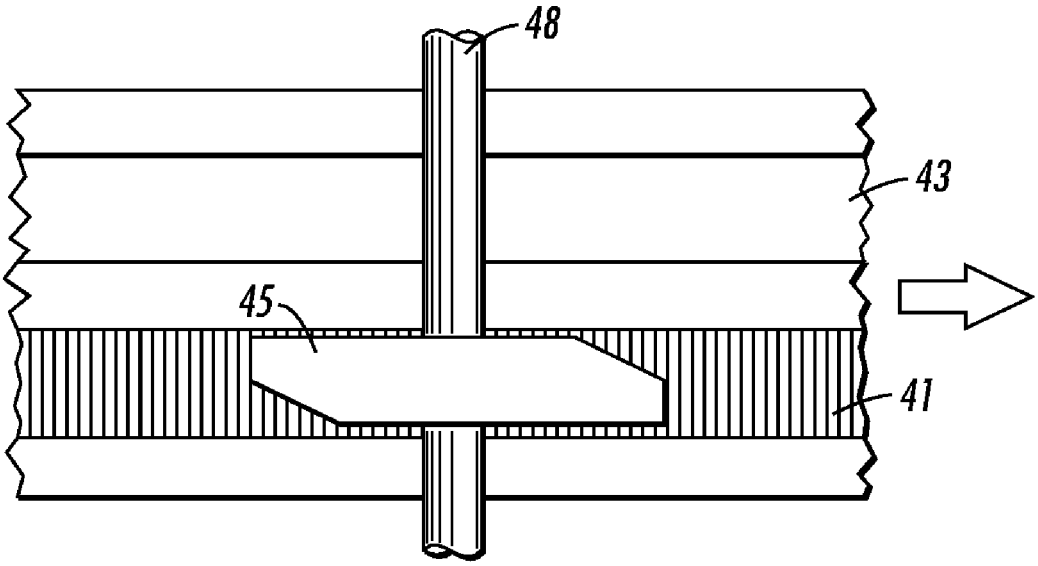
FIG. 4A is a top view showing a pawl positioned on the ratchet track.
Figure 4B:
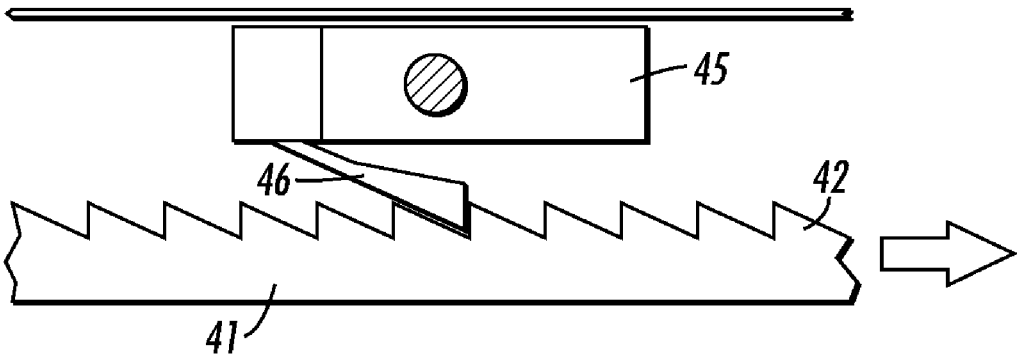
FIG. 4B is a side view of the pawl positioned on the ratchet track in FIG. 4A.
Figure 5A:
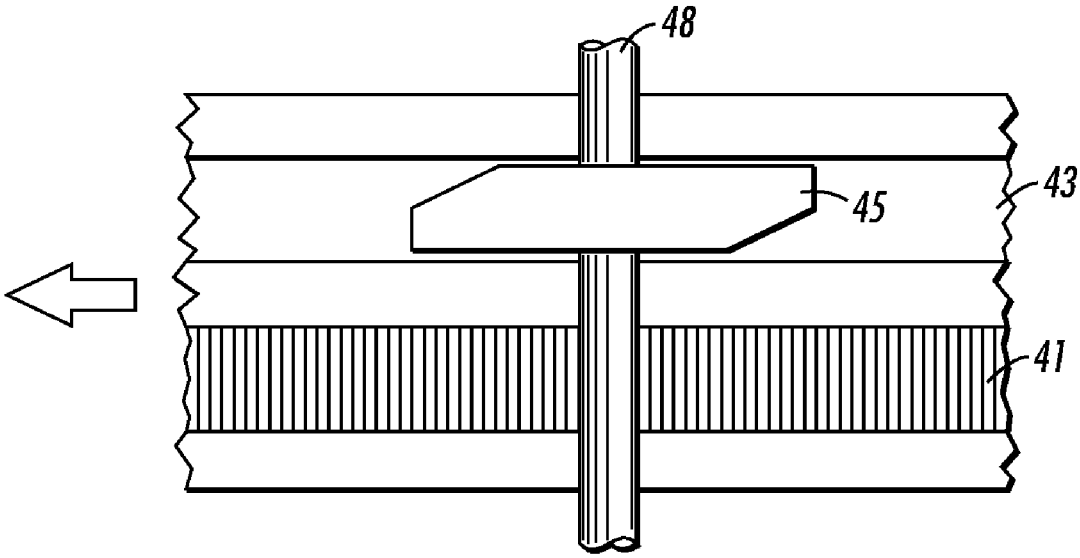
FIG. 5A is a top view showing the pawl of FIG. 4A positioned adjacent the ratchet track.
Figure 5B:
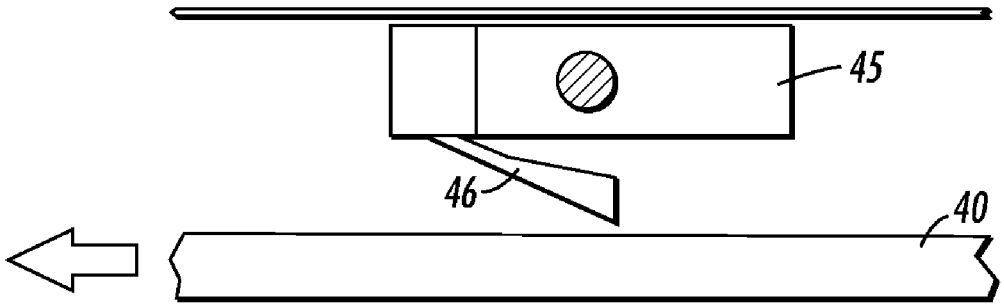
FIG. 5B is a side view showing the cleaner handle being reinserted into the printer.

In order to ensure that cleaner handle 40 is retracted completely during a corotron cleaning process, cleaner handle 40 in FIG. 3 includes a ratchet track 41 positioned on a portion of a pawl guide track 43 on its top surface. As shown in FIGS. 4A and 4B, a movable, translatable pawl 46 is supported by support member 45 that is fixedly mounted in the shell of corotron housing 39 though shaft 48. If desired, the pawl could be supported by the structure of the printer instead. Pawl 46 is spring loaded against corotron cleaning handle 40. The pawl pivots into contact with ratchet track 41 when handle 40 is being withdrawn from the CRU. The ratchet teeth 42 and pawl 46 are oriented such that the corotron cleaner handle 40 cannot be pushed back into the machine until the handle has been fully withdrawn from the machine in the direction of the arrow. When the handle reaches the end of its withdrawing travel, pawl 46 is shifted by the guiding track 43 to a position where it is no longer in contact with the ratchet track. As shown in FIGS. 5A and 5B, handle 40 is then free to be pushed back into the CRU in the direction of the arrow. When the handle is fully inserted into the CRU, pawl 46 is shifted by the guiding track 43 into contact with the ratchet track.

The ratchet mechanism ensures that the corotron cleaner handle 40 must be withdrawn from the CRU to its full extent. This ensures that the corotron charging elements are cleaned over their full length. An interlock feature on the machine front door will not allow the door to close completely if the corotron charging cleaner handle is not fully returned to its original position. The corotron cleaner handle must be fully inserted so that the front door can be fully closed and the interlock switch closed to allow machine operation.

Figure 6:
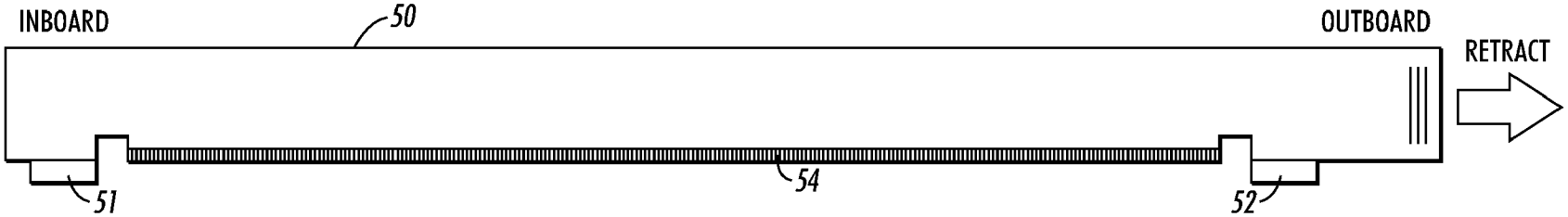
FIG. 6 is a top view of the corotron cleaner handle showing a ratchet track positioned on one side of the handle.
Figure 7A:
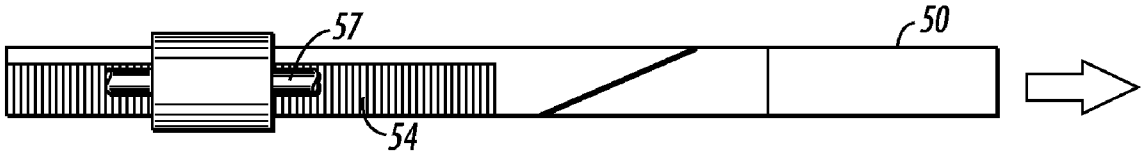
FIG. 7A is side view of the cleaner handle of FIG. 6 showing a pawl engaged in the ratchet track.
Figure 7B:
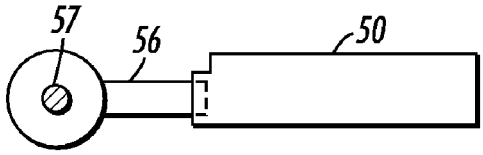
FIG. 7B shows an end view of FIG. 7A.
Figure 8A:
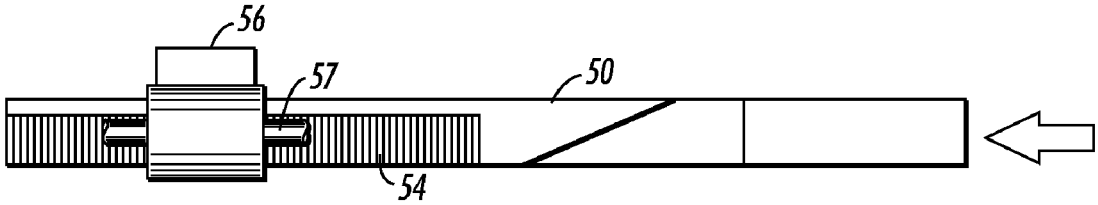
FIG. 8A is a side view showing the pawl of FIG. 7A riding on top of the cleaner handle.
Figure 8B:
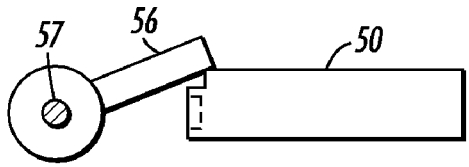
FIG. 8B is an end view of FIG. 8A.

Alternatively, cleaner handle 50 in FIG. 6 includes a ratchet track 54 positioned on one side thereof, as well as, pawl guide engage ratchet track 51 and pawl guide disengage ratchet track 52 positioned on opposite ends thereof. As shown in FIGS. 7A and 7B, a spring loaded rotating pawl 56 is supported by shaft 57 that is fixedly mounted in the shell of corotron housing 50. The pawl could also be supported by the structure of the printer instead. Pawl 56 is spring loaded against corotron cleaning handle 50. The pawl rotates into contact with ratchet track 54 when handle 50 is being withdrawn from the CRU. Teeth of the ratchet track 54 and pawl 56 are oriented such that the corotron cleaner handle 50 cannot be pushed back into the machine until the handle has been fully withdrawn from the machine in the direction of the arrow. Pawl 56 is engaged in ratchet track 54 until outboard pawl guide 52 rotates the pawl away from the ratchet track. As shown in FIGS. 8A and 8B, handle 50 is then free to be pushed back into the CRU in the direction of the arrow since the pawl is positioned on top of handle 50 at FIG. 8B. Spring loaded pawl 56 rides on top of handle 50 until inboard pawl guide 51 rotates pawl 56 back into position to engage ratchet track 54.

It should be understood that while this disclosure is directed to a manual corotron cleaning operation, it can easily be performed through automation by attaching a motor and conventional linkage to the corotron cleaning mechanism. In addition, while ratchet mechanisms have been disclosed as examples, other mechanisms can be used as long as they prevent the cleaner handle from being reinserted into the printer before it has been completely retracted.

In recapitulation, a mechanism has been described that uses a ratchet track and pawl to prevent reinsertion into a machine of a manual corotron cleaner handle until the handle has been fully retracted from the machine. This ensures that the cleaning pad or brush attached to the handle cleans the entire length of the corona element and print defects due to not cleaning contamination at the outboard end of the corona element are eliminated. When the cleaning handle has been fully retracted the pawl is shifted by a pawl guide track to a position no longer in contact with the ratchet track. The cleaner handle can then be reinserted into the machine. Upon full reinsertion, the guide track shifts the pawl back into contact with the ratchet tract to prepare for a new corotron cleaning cycle.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An electrophotographic printing machine of the type including a customer replaceable unit, comprising:

an imaging surface;

a charging device for placing a charge on the imaging surface, the charging device including a corona member having a predetermined length extending in an extension direction;

a cleaner handle movable along the extension direction from a home position to an end limit position, the handle including a cleaning member useful for cleaning the corona member; and a ratchet mechanism for preventing said handle once it has been extended to said end limit position in the extension direction from being moved a second time along said extension direction before said handle has been fully returned to said home position, thereby ensuring cleaning of the entire predetermined length of said corona member.

2. The printing machine of claim 1, wherein said ratchet mechanism includes a ratchet track positioned on top of said cleaner handle.

3. The printing machine of claim 2, wherein said ratchet mechanism includes a pawl guide.

4. The printing machine of claim 3, wherein said ratchet mechanism includes a pawl positioned against teeth of said ratchet track.

5. The printing machine of claim 4, wherein said pawl is spring-loaded against said teeth of said ratchet track.

6. The printing machine of claim 5, wherein said pawl rides on teeth of said ratchet track as said cleaner handle is pulled out of said customer replaceable unit.

7. The printing machine of claim 6, wherein said pawl is translatable.

8. The printing machine of claim 7, wherein said pawl is translated to a portion of said pawl guide such that it is removed from said ratchet track once said handle has been pulled to its full extent out of said customer replaceable unit.

9. The printing machine of claim 8, wherein said pawl is guided by said pawl guide to be repositioned on said ratchet track once said handle is completely reinserted into said customer replaceable unit.

10. The printing machine of claim 1, wherein said ratchet mechanism includes a ratchet track positioned on a side of said cleaner handle.

11. The printing machine of claim 10, wherein said ratchet mechanism includes at least two pawl guides.

12. The printing machine of claim 11, wherein said ratchet mechanism includes a pawl positioned against teeth of said ratchet track.

13. The printing machine of claim 12, wherein said pawl is spring-loaded against said teeth of said ratchet track.

14. The printing machine of claim 13, wherein said pawl rides on teeth of said ratchet track as said cleaner handle is pulled out of said customer replaceable unit.

15. The printing machine of claim 14, wherein said pawl is rotated to engage and retract said pawl for said ratchet track.

16. A xerographic device, comprising:

an imaging surface;

a charging device for placing a charge on said imaging surface, said charging device including a corona member extending in an extension direction;

a cleaner handle movable along said charging device in said extension direction to a travel limit; and an arrangement configured such that once said cleaner handle has been moved along said corona member to said limit of travel it prevents said cleaner handle from being pushed back along said charging device before said cleaner handle has been fully retracted, said arrangement including a ratchet mechanism.

17. The printing machine of claim 16, wherein said arrangement includes a ratchet track positioned on a side of said cleaner handle.

* * * * *